United States Patent [19]

Margen

[11] Patent Number: 4,750,336

[45] Date of Patent: Jun. 14, 1988

[54] ARRANGEMENT FOR PRODUCING ICE SLUSH

[76] Inventor: Peter Margen, Allhelgonavägen 21, 611 35, Nyköping, Sweden

[21] Appl. No.: 53,631

[22] Filed: May 26, 1987

[51] Int. Cl.[4] ..... F25D 17/02

[52] U.S. Cl. ..... 62/434; 62/59

[58] Field of Search ..... 62/59, 114, 185, 199, 62/434

[56] References Cited

U.S. PATENT DOCUMENTS

| | | | |
|---|---|---|---|
| 3,257,817 | 6/1966 | Leonard, Jr. | 62/59 X |
| 3,672,183 | 6/1972 | Bernstein | 62/59 X |
| 4,078,392 | 3/1978 | Kestner | 62/434 X |
| 4,302,944 | 12/1981 | Gainer | 62/59 |
| 4,671,077 | 6/1987 | Paradis | 62/59 X |

*Primary Examiner*—Lloyd L. King

*Attorney, Agent, or Firm*—Kinzer, Plyer, Dorn, McEahran & Jambor

[57] ABSTRACT

The present invention relates to an arrangement for producing an ice slush from an aqueous liquid which passes through at least one conduit (1) having cooled walls, and in which ice particles (13) can form. For the purpose of preventing ice from building-up on the cooled conduit walls, the arrangement includes means (10) for creating at least one helical, rotational path (11, 12) in the liquid such as to cause the liquid to contact the cooled wall surfaces of the conduit. Due to the lower density of the ice particles (13) generated in the liquid, the ice particles are drawn towards the center of the helical liquid flow (11, 12), while the heavier liquid particles move out towards the cooled walls of the conduit, under the influence of the gravitational forces generated.

14 Claims, 1 Drawing Sheet

ARRANGEMENT FOR PRODUCING ICE SLUSH

The present invention relates to an arrangement for producing ice slush, comprising at least one conduit the walls of which are cooled with the aid of a refrigerant and through which there is conducted an aqueous liquid in which small ice particles are able to form under the cooling influence of the conduit walls.

It is known that when certain substances, such as sugar or salt, are dissolved in water and the resultant solution is sufficiently cooled, crystalization nucleants are formed on which ice crystals or small ice particles grow in the solution. This mixture of solution and small ice particles gradually takes the form of an ice slush, which can be used to great advantage as a high-capacity cold store in refrigerators, freezers, air conditioning plants and heat pump systems.

The conduit walls cooled by said refrigerant must be maintained at a temperature beneath that of the liquid, therewith impairing the ability of the walls to absorb heat from the liquid. Furthermore, in known arrangements of this kind the conduit walls are prone to become coated in ice, therewith impeding the flow of liquid through the conduit. Consequently, mechanical devices, e.g. scrapers, are used to remove ice from the conduit walls, from time to time.

It is also known to produce a slush from ice particles and liquid, by mixing together water and other substances such as calcium chloride, sodium chloride and ethylene glycol, and cooling the resultant suspension or solution. Another known method of producing ice slush involves injecting droplets of water into a water-immiscible liquid that has a temperature beneath that at which water freezes. As a result, ice particles are formed in the liquid, these ice particles being removed and mixed with water in a storage tank.

The mixture of ice particles and water, ice slush, produced in accordance with any of these methods, or in accordance with any other known method, is collected in a relatively large store, from which the liquid, at a temperature of 0° C., or somewhat lower, is pumped through conduits into cooling apparatus incorporated in, e.g. air conditioning plants. The liquid can be heated to a maximum of 10° C. in such cooling apparatus, in order to obtain the requisite cooling effect. It will readily be seen that under conditions such as these large quantities of liquid must be pumped between the store and the cooling apparatus per unit of time, and hence the conduits must be given such large diameters as would otherwise be considered impracticable. Consequently, it has recently been proposed to circulate the ice slush itself in the system, wherewith the ice particles are permitted to melt in the cooling or refrigerating apparatus. The cooling capacity thus achieved is sufficiently great to enable conduits of normal size to be used.

Obviously, it is always endeavoured to solve a technical problem in the simplest and best way possible, which also applies to the preparation of ice slush for the aforesaid purpose. When the actual ice slush itself is to be circulated through a system of conduits, as with the last mentioned case, it is essential that the ice particles present in the slush are small and not agglomerated to form large clumps or larger discrete particles liable to block the conduits.

The object of the present invention is primarily to provide a more simple and more effective arrangement for producing ice slush, and secondarily to provide such an arrangement which will produce particularly fine ice particles of uniform size.

These objects are achieved with an arrangement constructed in accordance with the invention as defined in the following claims. Because the liquid located adjacent the cooled conduit walls where formation of the ice particles takes place is forced to move in a helical path, the newly formed ice particles are entrained with the liquid along this path, and because the ice particles have a lower density than the liquid, the liquid is forced towards the cooled conduit wall by the ensuing centrifugal forces, whereas the lighter ice particles move in towards the center line of the helical liquid flow and are transported at the same time in the axial direction of the conduit. This effectively prevents the ice particles from freezing on the cooled walls of the conduit, and the ice particles, once formed, are carried away from said walls immediately, by the helical liquid flow. Furthermore, the formation of large ice particles of irregular sizes is avoided, as distinct from the situation in which it is necessary to scrape ice from the conduit walls, as in the case of known arrangements of this kind.

So that the invention will be more readily understood and further features thereof made apparent, various embodiments of an arrangement according to the invention will now be described in more detail with reference to the accompanying schematic drawing, in which FIG. 1 is a simplified, longitudinal view of a first embodiment of the invention;

Figure 1:
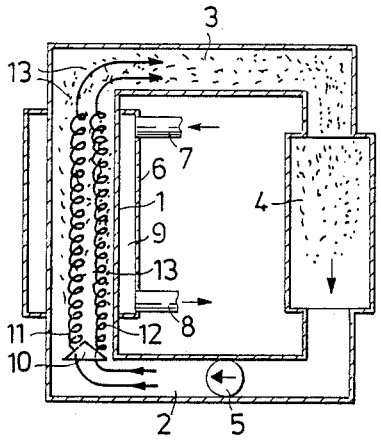

The arrangement illustrated in FIG. 1 comprises a main conduit 1 having connected thereto a delivery conduit 2 and an outlet conduit 3 which extend respectively from and to an air conditioning circuit 4, around which a liquid, e.g. a sodium chloride solution, is driven by means of a pump 5.

The main conduit 1 is surrounded by a cooling jacket 6 provided with an inlet 7 and an outlet 8 which lead respectively from and to a cooling arrangement (not shown) which drives a refrigerant through the illustrated space 9 located between the main conduit 1 and the cooling jacket 6. An obliquely positioned, triangular metal plate 10 is located at the inlet to the main conduit 1, so as to generate in a known manner two intensive, helical liquid flows 11, 12 downstream of the plate 10 as the liquid flows past the plate.

The liquid flowing through the main conduit 1 comes into contact with the walls of the conduit and is cooled by said walls to a temperature at which ice particles 13 form in regions adjacent said walls. Since the density of the ice particles 13 is much lower than the density of the salt solution in the main conduit, the salt solution will be forced out towards the conduit walls, whereas the ice particles 13 are drawn in towards the center lines of the helically rotating liquid, while, at the same time, being transported axially towards the outlet conduit 3.

Figure 2:
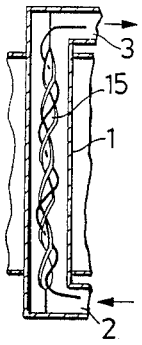
FIGS. 2 and 3 are respective longitudinal sectional views of a second and a third embodiment of the invention.

FIG. 2 illustrates an alternative method of generating a helical, rotating liquid flow in the main conduit 1. In this embodiment the necessary helical motion of the liquid is generated with the aid of a helically twisted strip 15 placed in the conduit, this strip being either made of metal or a plastics material.

Figure 3:
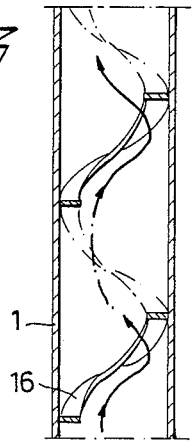

FIG. 3 illustrates a further alternative embodiment, in which the liquid is imparted helical motion with the aid of a helical strip 16 of round or rectangular cross-section, attached to the inner wall surfaces of the main conduit 1.

Figure 4:
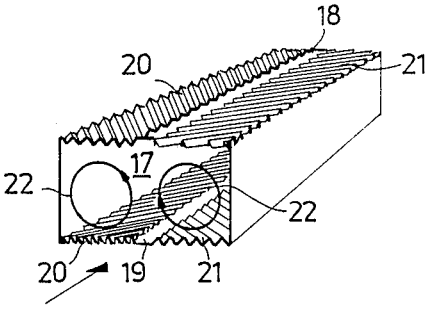
FIG. 4 is a perspective view of a fourth embodiment of the invention, in which the main conduit is of rectangular cross-section.

As illustrated in FIG. 4, which relates to a conduit of rectangular cross-section, one or more helically rotating flows can be formed in the liquid, by allowing the liquid to flow into a gap 17 located between two walls 18, 19 that incorporate one or more rows of inclined ridges 20, 21, the inclined ridges of one wall 18 extending so as to cross the inclined ridges on the other wall 19. Two adjacent rows of ridges 20, 21 on each wall 18, 19 are suitably in arrow formation, so that the two rotational flows 22 will rotate in mutually opposite directions.

Figure 5:
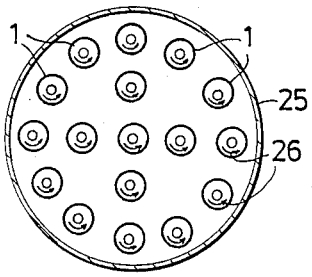
FIGS. 5 and 6 are cross-sectional views of two functionally dissimilar embodiments in which the liquid is caused to flow in a plurality of mutually parallel rotational paths.

In order to obtain an arrangement of suitable capacity, a plurality of conduits 1 may be arranged parallel with one another in a common refrigerant container 25, with devices provided in the conduits 1 for generating rotary motion 26 in the liquid, as illustrated in FIG. 5.

Figure 6:
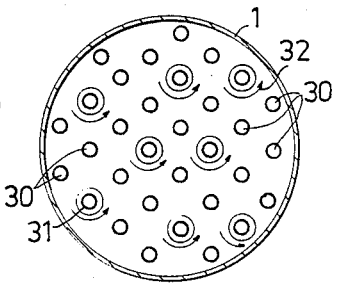

A functionally different arrangement is illustrated in FIG. 6. In this case a plurality of mutually parallel refrigerant-conducting pipes 30 are arranged in the conduit 1, parallel with its longitudinal axis. Located between respective pipes are devices 31 for generating helical flows 32, these devices being so positioned that each such helical flow moves in contact with the outer surfaces of a multiple of pipes 30, which are cooled.

I claim:

1. An arrangement for producing ice slush, comprising at least one conduit (1) having walls which are cooled by means of a refrigerant, and which conduit is intended to conduct an aqueous liquid in which small ice particles (13) are able to form in the conduit under the influence of the cooling effect of said walls, characterized in that the arrangement includes stationary guide means (10) for generating in said conduit at least one helical liquid flow (11, 12) relative to the cooled walls of the conduit during passage of the liquid through the conduit, by means of which helical flow lighter ice particles (13) under the influence of centrifugal forces are moved in towards the center of the helical liquid flow while heavier liquid particles are moved out towards the cooled walls of the conduit (1).

2. An arrangement according to claim 1, characterized in that the cooled walls of the conduit consist of the inner walls of the conduit (1).

3. An arrangement according to claim 2, characterized in that the conduit (1) has arranged therein a helical guide surface (15, 16) which extends co-axially with the conduit and which is operative in causing the liquid to flow in a helical rotational path.

4. An arrangement according to claim 1 characterized in that the arrangement comprises a plurality of mutually parallel conduits (1) arranged in a container (25) through which a refrigerant flows in contact with the outer surfaces of the conduits (1).

5. An arrangement according to claim 1, characterized in that the cooled walls of the conduit (1) comprise a plurality of mutually parallel refrigerant-conducting pipes (13) which are located in the conduit (1) parallel with the longitudinal axis thereof together with helical guide surfaces (31) which are positioned between said pipes with the centre axis of said surfaces extending parallel with the pipes, said guide surfaces being operative to generate a plurality of helical liquid flows (32) in said conduit.

6. An arrangement according to claim 1, characterized in that the cooled walls of the conduit include at least one pair of elongated, mutually parallel wall surfaces (18, 19) located in mutually opposed relationship with an intermediate space (17) in which liquid flows in the longitudinal direction of the surfaces; and in that each of the wall surfaces is provided with at least one row of inclined, mutually parallel ridges (20, 21), of which the ridges of one wall surface (18) extend to cross the ridges on the other wall surface (19), such as to impart the aforesaid helical motion (22) to said liquid.

7. An arrangement according to claim 1 characterized in that the liquid consists of a solution or a mixture of water and calcium chloride or sodium chloride, or sugar or ethylene glycol respectively.

8. An arrangement according to claim 2 characterized in that the arrangement comprises a plurality of mutually parallel conduits (1) arranged in a container (25) through which a refrigerant flows in contact with the outer surface of the conduits (1).

9. An arrangement according to claim 3 characterized in that the arrangement comprises a plurality of mutually parallel conduits (1) arranged in a container (25) through which a refrigerant flows in contact with the outer surface of the conduits (1).

10. An arrangement according to claim 2 characterized in that the liquid consists of a solution or a mixture of water and calcium chloride or sodium chloride, or sugar or ethylene glycol respectively.

11. An arrangement according to claim 3 characterized in that the liquid consists of a solution or a mixture of water and calcium chloride or sodium chloride, or sugar or ethylene glycol respectively.

12. An arrangement according to claim 4 characterized in that the liquid consists of a solution or a mixture of water and calcium chloride or sodium chloride, or sugar or ethylene glycol respectively.

13. An arrangement according to claim 5 characterized in that the liquid consists of a solution or a mixture of water and calcium chloride or sodium chloride, or sugar or ethylene glycol respectively.

14. An arrangement according to claim 6 characterized in that the liquid consists of a solution or a mixture of water and calcium chloride or sodium chloride, or sugar or ethylene glycol respectively.

* * * * *